United States Patent [19]

Jonasson

[11] Patent Number: 4,528,820

[45] Date of Patent: Jul. 16, 1985

[54] METHOD AND APPARATUS FOR REMOVING FROST DEPOSITS FROM COOLING-COIL BATTERIES

[75] Inventor: Staffan M. O. Jonasson, Helsingborg, Sweden

[73] Assignee: Frigoscandia Contracting AB, Helsingborg, Sweden

[21] Appl. No.: 39,246

[22] Filed: May 15, 1979

[30] Foreign Application Priority Data

May 19, 1978 [SE] Sweden ..... 7805781

[51] Int. Cl.[3] ..... F25D 21/00

[52] U.S. Cl. ..... 62/80; 165/95; 15/316 R

[58] Field of Search ..... 62/282, 82, 255, 80; 165/95; 75/316 R

[56] References Cited

U.S. PATENT DOCUMENTS

| | | | |
|---|---|---|---|
| 1,978,555 | 10/1934 | Snow | 165/95 |
| 2,097,851 | 11/1937 | Wenzl | 62/282 |
| 2,130,036 | 9/1938 | Shrader | 62/282 |
| 2,634,659 | 4/1953 | Jordanoff | 15/316 R |
| 3,828,570 | 8/1974 | Stutz | 62/82 X |
| 4,006,601 | 2/1977 | Ballarin et al. | 62/80 |

FOREIGN PATENT DOCUMENTS

| | | | |
|---|---|---|---|
| 23515 | 10/1949 | Finland | 165/95 |

*Primary Examiner*—Henry Bennett

*Attorney, Agent, or Firm*—Karl W. Flocks; Sheridan Neimark; A. Fred Starobin

[57] ABSTRACT

This invention relates to a method of removing frost deposits from cooling-coil batteries or the like in a freezing plant during operation, while maintaining the state of aggregation of the removed frost deposit. According to the invention the frost deposit is recurrently removed by a current of compressed air being directed towards and brought to sweep over the cooling-coil batteries.

The invention also concerns an apparatus for carrying out the method, said apparatus including at least one compressed-air nozzle which is adapted to be recurrently directed towards and brought to sweep over said cooling-coil batteries in order to blow away the frost deposit.

10 Claims, 2 Drawing Figures

METHOD AND APPARATUS FOR REMOVING FROST DEPOSITS FROM COOLING-COIL BATTERIES

Figure 2:
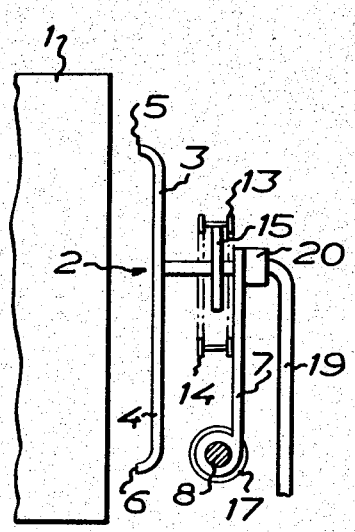

The present invention relates, on one hand, to a method of removing frost deposits from cooling-coil batteries or the like in a freezing plant during operation, while maintaining the state of aggregation of the removed frost deposit, and, on the other hand, an apparatus for carrying out the method.

In cold-storage rooms and freezing plants, the air, which is circulated over the foodstuffs, is normally cooled by means of an air cooler. The air coolers used for this purpose usually consist of lamella type batteries or finned tubes. The air moisture causes formation of frost on the air cooler, which gradually diminishes the heat transmission coefficient and rereduces the viability for air and, consequently, the cooling power. This makes it necessary to remove the frost deposits at certain intervals.

The most common methods of removing such frost deposits have all the disadvantage that the air cooler must be switched off and heated in order thereby to melt the frost. Among prior art methods to this effect there may be mentioned electrical resistance heating, "hot gas defrosting" (the flow of refrigerants being reversed in a suitable way so that the evaporator functions as a condenser during the defrosting operation) and water defrosting (the cooling-coil battery being heated with overflowing water). The disadvantages entailed with these defrosting methods reside in that the cooling-coil batteries as a rule must be switched off during the defrosting operation and that moisture forms around the cooling-coil batteries, which will soon result in new frost deposits. These defrosting methods also require considerable amounts of energy which substantially will be lost.

In addition to the defrosting methods described above there are methods of defrosting air coolers during operation by pouring a suitable chemical, e.g. a glycol/-water solution, on the air-cooler. However, these methods have the disadvantage that they are complicated, they require a certain equipment for distilling away the melted frost and they require special arrangements to prevent the chemical splashing onto the foodstuff in the form of drops.

A primary object of the present invention is to provide, while avoiding the above-mentioned disadvantages, a method of removing frost deposits from cooling-coil batteries or the like in a freezing plant during operation, while maintaining the state of aggregation of the removed frost deposits, and an apparatus for carrying out the method, which is of simple and reliable construction and function.

This object is realized by the present invention according to which the method of removing the deposits of frost from cooling-coils or the like during operation is characterized in that the frost deposit is recurrently removed by a current of compressed air being directed towards, and brought to sweep over the cooling-coil batteries, and the apparatus for carrying out the method is characterized in that it comprises at least one compressed-air nozzle which is adapted to be recurrently directed towards and brought to sweep over the cooling-coil batteries in order to blow away the frost deposit from the cooling-coil batteries by means of a current of compressed air.

Figure 1:
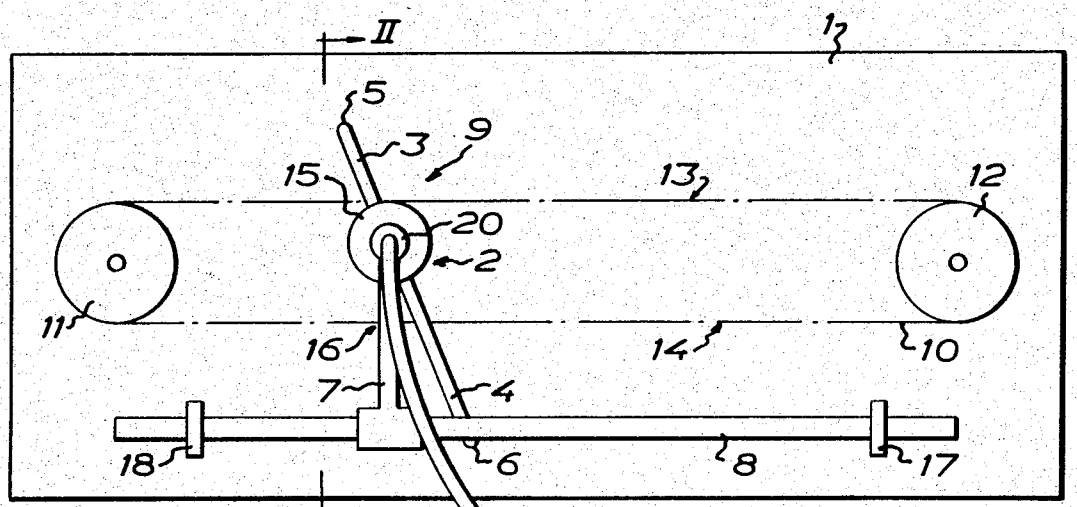

The invention will be described in greater detail hereinafter with reference to the accompanying drawing which illustrates preferred embodiments and in which:

FIG. 1 is a side elevation of a first embodiment of an apparatus according to the invention for removing frost deposits from cooling-coil batteries or the like; and FIG. 2 is a sectional view on line II—II of FIG. 1.

FIG. 1 shows schematically a cooling-coil battery 1 and a defrosting apparatus according to the invention designed to blow away frost deposits from the cooling-coil battery by means of compressed air. The apparatus includes a nozzle means 2 which, according to a preferred embodiment, consists of two oppositely directed pipes 3, 4 of different length, which are bent at their free ends so that their mouths 5 and 6 are directed towards the cooling-coil battery, a support 7 at one end of which the nozzle means is rotatably mounted in the vertical plane and the other end of which is mounted to slide on a rail 8 extending longitudinally of the cooling-coil battery, and a driving means 9 adapted to reciprocate the nozzle means 2 longitudinally of the cooling-coil battery during rotation of the nozzle means.

The driving means 9 includes an endless chain 10 which is passed over two chain wheels 11, 12 and the upper and lower parts 13 and 14 of which are generally parallel with the rail 8, and a chain wheel 15 which is fixedly secured to the nozzle means 2.

The chain wheel 15 is adapted to mesh with the upper part 13 of the chain 10 and the support 7 is fixedly connected, at 16, to the lower part 14 of the chain 10.

If the chain 10 is driven in such a way that the upper part 13 moves to the left relative to the drawing and the lower part 14 consequently moves to the right relative to the drawing, then the support 7 will be displaced to the right while the nozzle means 2 will rotate in anticlockwise direction due to the chain wheel 15 being in mesh with the upper part 13. When the support abuts a stop 17, which is provided on the rail 8 before the chain wheel 12, the chain 10 will change direction of travel and the nozzle means will move to the left while effecting a rotational movement in clockwise direction until the support abuts a stop 18 where the chain changes its direction of travel again. Consequently, the nozzle means can be reciprocated along the cooling-coil battery 1 until this is defrosted.

As the mouths 5 and 6 of the nozzle means 2 are situated at different distances and in different directions relative to the center of the chain wheel 15, the compressed-air jets directed towards the cooling-coil battery will follow different paths during the defrosting process, whereby a larger zone of the cooling-coil battery is exposed to said jets. It is of course possible within the scope of the invention to arrange a larger or smaller number of mouths on the nozzle means.

The compressed air is supplied to the nozzle means 2 from a flexible conduit 19 which is communication with the nozzle means via a swivel connection 20.

To obtain better efficiency in blowing away the frost deposits one may incorporate with the apparatus of the invention a means causing the compressed-air jet directed towards the cooling-coil battery to pulsate. This means produces a percussion effect on the frost deposit, which facilitates and accelerates loosening.

As the principal object of the invention is to remove frost deposits during operation, the apparatus of the invention is allowed to work at intervals. It is important, however, that the period of time between these intervals is not too long so that the apparatus fails to remove the frost deposits being formed in the meantime.

If so required in order to prevent the components of the defrosting apparatus from freezing fast or the nozzle from being clogged by freezing, the system is provided with electric heating, e.g. a heating cable.

The driving unit is preferably operated by means of a separate motor which is connected either to one of the chain wheels 11, 12 and 15 or to the support 7 which may include e.g. a gear reduction set in which the rail 8 is the rack.

An alternative way of reciprocating the nozzle means along the cooling-coil battery resides in that the reaction power of the compressed air flowing out from the mouths causes the nozzle means to rotate. According to this particular embodiment the mouths of the nozzle means should be orientable at different angles to the side of the cooling-coil battery so that the angles of said mouths relative to said side are changed when the nozzle means abuts the stops 17 and 18, at which moment the nozzle means starts rotating in the opposite direction.

It is also possible within the scope of the present invention to move the nozzle means in other ways along the cooling-coil battery. In this connection, however, it is important that the current of compressed air directed towards the cooling coil battery should cover the battery to an extent such that all frost deposits will be blown away therefrom.

It should be pointed out, however, that the most characteristic feature of the invention resides in that the frost deposit is recurrently removed from the cooling-coil batteries through mechanical action while maintaining the state of aggregation of the removed frost deposit.

It is easily understood that the apparatus of the invention may be secured to a stand (not shown), whereby the entire apparatus may be moved from a cooling-coil battery to another.

The invention may of course be modified in various ways within the scope of the appendant claims.

What we claim and desire to secure by Letters Patent is:

1. A method of recurrently removing frost deposits from cooling-coil batteries or the like in a freezing plant during operation of such plant while maintaining the frost so removed in its aggregated form, comprising the steps of recurrently directing currents of compressed air of such temperature as to not melt the frost deposits and of such pressure as to thereby blow frost deposits off and away from the cooling-coil batteries so that the state of the frost being removed is maintained, said currents of compressed air being directed in a sweeping fashion toward and over the cooling-coil batteries of the plant while maintaining the cooling operation of the cooling-coil batteries.

2. A method as claimed in claim 1, including the step of pulsating the compressed-air current that is directed toward and over the cooling-coil batteries.

3. A method as claimed in claim 1 or 2, wherein the compressed air is directed from a nozzle which is reciprocated longitudinally of the cooling-coil batteries and is at the same time reciprocated in a direction which is generally perpendicular to the longitudinal direction.

4. Apparatus for recurrently removing frost deposits from cooling-coil batteries or the like in a freezing plant during operation, while the state of aggregation of the removed frost deposit is maintained, wherein said apparatus includes at least one compressed-air nozzle and means supporting said nozzle for imparting reciprocating motion to said nozzle longitudinally of the cooling-coil batteries and simultaneously imparting reciprocating motion to said nozzle in a direction generally perpendicular to the longitudinal direction so that in operation of said apparatus said nozzle is recurrently directed towards and brought to sweep over said cooling-coil batteries in order to blow away the frost deposit from the cooling-coil batteries by means of a current of compressed air, and means for furnishing compressed air of such pressure and temperature as to blow frost deposits from the cooling-coil batteries without melting such frost.

5. Apparatus as claimed in claim 4, comprising a means causing the compressed-air current to pulsate.

6. Apparatus as claimed in claim 5, wherein said support means for the compressed-air nozzle is adapted to be reciprocated longitudinally of the cooling-coil batteries at the same time as the compressed-air nozzle is adapted to be reciprocated in a direction which is generally perpendicular to the direction of travel of the support means.

7. Apparatus as claimed in claim 6, wherein the support means is mounted at one end thereof to slide on a rail extending longitudinally of the cooling-coil batteries, and the nozzle is mounted at the other end of the support means, with said nozzle being adapted to effect a circular movement when the support means move along the cooling-coil batteries.

8. Apparatus as claimed in claim 7, wherein an endless chain is disposed longitudinally of the cooling-coil batteries and has its two parts disposed in parallel with the rail, a chain wheel, connected with the nozzle, being adapted to mesh with one part and the support being fixed to the other part, the displacement of the support and the nozzle being effected in said directions in that the parts are brought to reciprocate.

9. Apparatus as claimed in any of claims 4–8, wherein a swivel connection is attached to the nozzle, the compressed air being supplied to the nozzle via said swivel connection.

10. Apparatus as claimed in claim 9, wherein two or more mouths are provided on the nozzle and follow different paths.

* * * * *